US010102744B2

(12) United States Patent
Dhondse et al.

(10) Patent No.: US 10,102,744 B2
(45) Date of Patent: Oct. 16, 2018

(54) PREDICTIVE TRAFFIC MANAGEMENT USING VIRTUAL LANES

(71) Applicant: International Business Machines Corporation, Armonk, NY (US)

(72) Inventors: Amol Ashok Dhondse, Pune (IN); Selene M. O. Nunez, Mexico City (MX); Anand Pikle, Pune (IN); Gandhi Sivakumar, Victoria (AU); Ana P. H. Veerkamp, Miguel Hidalgo (MX)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/277,695

(22) Filed: Sep. 27, 2016

(65) Prior Publication Data

US 2018/0089994 A1 Mar. 29, 2018

(51) Int. Cl.

| | |
|---|---|
| ***G08G 1/01*** | (2006.01) |
| ***G08G 1/056*** | (2006.01) |
| ***G08G 1/07*** | (2006.01) |
| ***G08G 1/09*** | (2006.01) |

(52) U.S. Cl.
CPC ..... *G08G 1/0145* (2013.01); *G08G 1/056* (2013.01); *G08G 1/07* (2013.01); *G08G 1/09* (2013.01)

(58) Field of Classification Search
CPC ..... G08G 1/0145; G08G 1/056; G08G 1/07; G08G 1/09
See application file for complete search history.

(56) References Cited

U.S. PATENT DOCUMENTS

| | | | |
|---|---|---|---|
| 4,818,048 | A | 4/1989 | Moss |
| 6,556,916 | B2 | 4/2003 | Waite et al. |
| 7,307,545 | B2 | 12/2007 | Nishida |
| 8,812,193 | B2 | 8/2014 | Luke et al. |
| 8,996,197 | B2 | 3/2015 | Joh et al. |
| 9,672,734 | B1 * | 6/2017 | Ratnasingam ..... G08G 1/0112 |

(Continued)

FOREIGN PATENT DOCUMENTS

| | | |
|---|---|---|
| CN | 104240495 A | 6/2013 |
| EP | 07425834.4 | 12/2007 |

OTHER PUBLICATIONS

John Ryan, VW's New Hologrpahic Dashboard GPS Navigator, http://www.psfk.com/2011/05/vws-new-holographic-dashboard-gps-navigator-video.html; pp. 1-3; May 4, 2011.

(Continued)

*Primary Examiner* — Michael D Lang
(74) *Attorney, Agent, or Firm* — George R. McGuire; Bond Schoeneck & King, PLLC; John Pivnichny

(57) ABSTRACT

A computing system for predictive traffic management using virtual lanes. In an embodiment, the system dynamically monitors and collects traffic conditions in real time, performs analytics on the collected traffic data, utilizes a neural network or other self-learning computer to assist in predictive traffic modeling, and interfaces with a public transfer system to provide an allocation/reallocation of lanes available for traffic use to optimize traffic flow and/or control traffic signals, and can provide vehicles (human driver or driverless/self-driving) with real time optimal route guidance, including use of alternate routes and a holographic image that shows and may also provide audio indications of lane allocation.

8 Claims, 5 Drawing Sheets

(56) References Cited

U.S. PATENT DOCUMENTS

| | | | | |
|---|---|---|---|---|
| 2008/0183386 | A1 | 7/2008 | Klausner et al. | |
| 2010/0238283 | A1 | 9/2010 | Kim | |
| 2011/0301813 | A1 | 12/2011 | Sun et al. | |
| 2014/0207377 | A1 | 7/2014 | Gupta et al. | |
| 2014/0278052 | A1* | 9/2014 | Slavin | G01C 21/3492 701/400 |
| 2015/0025789 | A1 | 1/2015 | Einecke et al. | |
| 2015/0194055 | A1 | 7/2015 | Maass | |
| 2016/0203717 | A1* | 7/2016 | Ginsberg | G08G 1/07 701/117 |

OTHER PUBLICATIONS

Predictive Virtual Lane Using Relative Motions Between a Vehicle and Lanes, 2013 IEEE Intelligent Vehicles Symposium (IV) Jun. 23-26, 2013, Gold Coast, Australia.

Efficient Vehicle Driving on Multi-lane Roads Using Model Predictive Control Under a Connected Vehicle Environment, 2015 IEEE Intelligent Vehicles Symposium (IV) Jun. 28-Jul. 1, 2015. COEX, Seoul, Korea.

* cited by examiner

PREDICTIVE TRAFFIC MANAGEMENT USING VIRTUAL LANES

BACKGROUND

The present invention relates generally to traffic management control, and more particularly to real-time predictive traffic management using virtual lanes.

Traffic management is typically achieved through implementation of traffic patterns based upon historic data. For example, because it is known, as an example, that more vehicles travel north on a particular route during the early morning hours that travel south along the same route, more driving lanes may be allocated for the northbound traffic during those early morning hours. Likewise, if the later afternoon/early evening hours are known to produce heavier vehicle traffic in the southbound lanes than the northbound lanes, more southbound lanes can be allocated to accommodate such increased traffic. The decision for managing the traffic through such lane allocations is entirely static, however, and not based on the real-time assessment of the traffic conditions. Thus, if an event occurs that backs up traffic in the direction where there are fewer lane allocations, it is unlikely that additional lanes can be allocated at that moment the traffic becomes congested.

In addition to the static nature of the traffic management, drivers of vehicles are given little to no information for purposes of taking alternate routes should one such alternative become favored over a typically more preferred route. Thus, if a driver is taking a first route that happens to be experiencing traffic issues a short distance away, the driver is generally unaware of the forthcoming traffic delays and given an instantaneous option to take an alternate route or to simply use different driving lanes that will be more efficient based on present conditions. While some technologies may provide a driver with data on traffic conditions on a given route at a particular time, they require the driver to take the initiative to seek out such data.

It is a principal object and advantage of the present invention to provide a system that can capture traffic density data generated by road/lane mounted sensors for automated density analysis and traffic management.

It is another object and advantage of the present invention to provide a system that can perform traffic route optimization using predictive traffic flow analytics and allocate lanes in each direction.

It is a further object and advantage of the present invention to provide a system that assists human drivers of vehicles with audio-visual virtual lane imagery based on dynamic allocation of lanes.

It is an added object and advantage of the present invention to provide a system that assists in navigation for a vehicle based on current location and optimal route as determined by remote and centralized traffic control apparatus.

Other objects and advantages of the present invention will in part be obvious and in part appear hereinafter.

SUMMARY

In one aspect of the present invention, it generally provides a system and method for predictive traffic management using virtual lanes. Sensors for sensing traffic conditions on roads and sensors on vehicles that can interact with the road sensors are used to collect and transmit/supply traffic data to an analytics engine. The analytics engine receives, stores, and processes the traffic data in real time. Subsystems within the analytics engine include analysis, modeling, and self-learning (e.g., neural network) modules for analyzing the traffic density, predicting traffic flow, providing personal preferences for any particular user, and a module for optimizing traffic flow and providing alternate route options.

An embodiment of the present invention provides a system for providing navigation assistance to a vehicle based on the vehicle's current position, comprising (a) a plurality of sensors adapted for positioning along a roadway, detecting the movement of vehicles operatively passing the sensor and generating vehicle movement data, and transmitting the vehicle movement data; (b) a vehicle sub-system, comprising: a first geo-location based transmitter adapted for attachment to the vehicle and generating and transmitting vehicle position; and a navigation assistant; and (c) a computing system located remote from the plurality of sensors and the vehicle sub-system, comprising: a digital receiver for receiving the vehicle movement data transmitted from at least one of the plurality of sensors; a digital controller adapted to receive the vehicle movement data from the digital receiver and the vehicle position data from the first geo-location based transmitter; a traffic control management module for processing traffic data and transmit the processed traffic data to the digital controller; and a digital transmitter for receiving data from the digital controller and transmitting the data to the navigation assistant.

In one aspect of the invention, the system provides a preference based personal advisor. In another aspect, the system provides a traffic flow optimizer.

In another aspect, the system provides a predictive traffic flow modeler.

In another aspect, the system provides a self-learning data processor.

In another aspect, the system provides a traffic density analyzer.

In another aspect, the system provides a geo-location based data unit.

It is another aspect of the invention to provide a method for providing navigation assistance to a vehicle based on the vehicle's current position, comprising the steps of: (a) receiving in a computing system data representative of sensed vehicular traffic from traffic lanes on a roadway; (b) aggregating the sensed vehicular traffic data in a computer controller; (c) receiving in the computing system geolocation data for a vehicle; (d) providing the computing system with data representative of preferred traffic guidance for the vehicle; (e) providing the computing system with data representative of predictive traffic flow for the traffic lanes; and (f) transmitting from the computing system to the vehicle data representative of route guidance instructions based upon the predictive traffic flow data, the vehicular traffic data, and the preferred traffic guidance data.

It is another aspect of the invention to provide a computer program product providing predictive traffic management and lane allocation based on a vehicle's current position, the computer program product comprising a computer readable storage medium having program instructions embodied therewith, wherein the computer readable storage medium is not a transitory signal per se, the program instructions are readable by a computer to cause the computer to perform a method comprising: (a) receiving in a computing system data representative of sensed vehicular traffic from traffic lanes on a roadway; (b) aggregating said sensed vehicular traffic data in a computer controller; (c) receiving in said computing system geolocation data for a vehicle; (d) providing said computing system with data representative of preferred traffic guidance for said vehicle; (e) providing said computing system with data representative of predictive traffic flow for said traffic lanes; (f) transmitting from said computing system to said vehicle data representative of route guidance instructions based upon said predictive traffic flow data, said vehicular traffic data, and said preferred traffic guidance data; and (g) transmitting from said computing system to a public transfer system data to control traffic lights and lane allocations.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
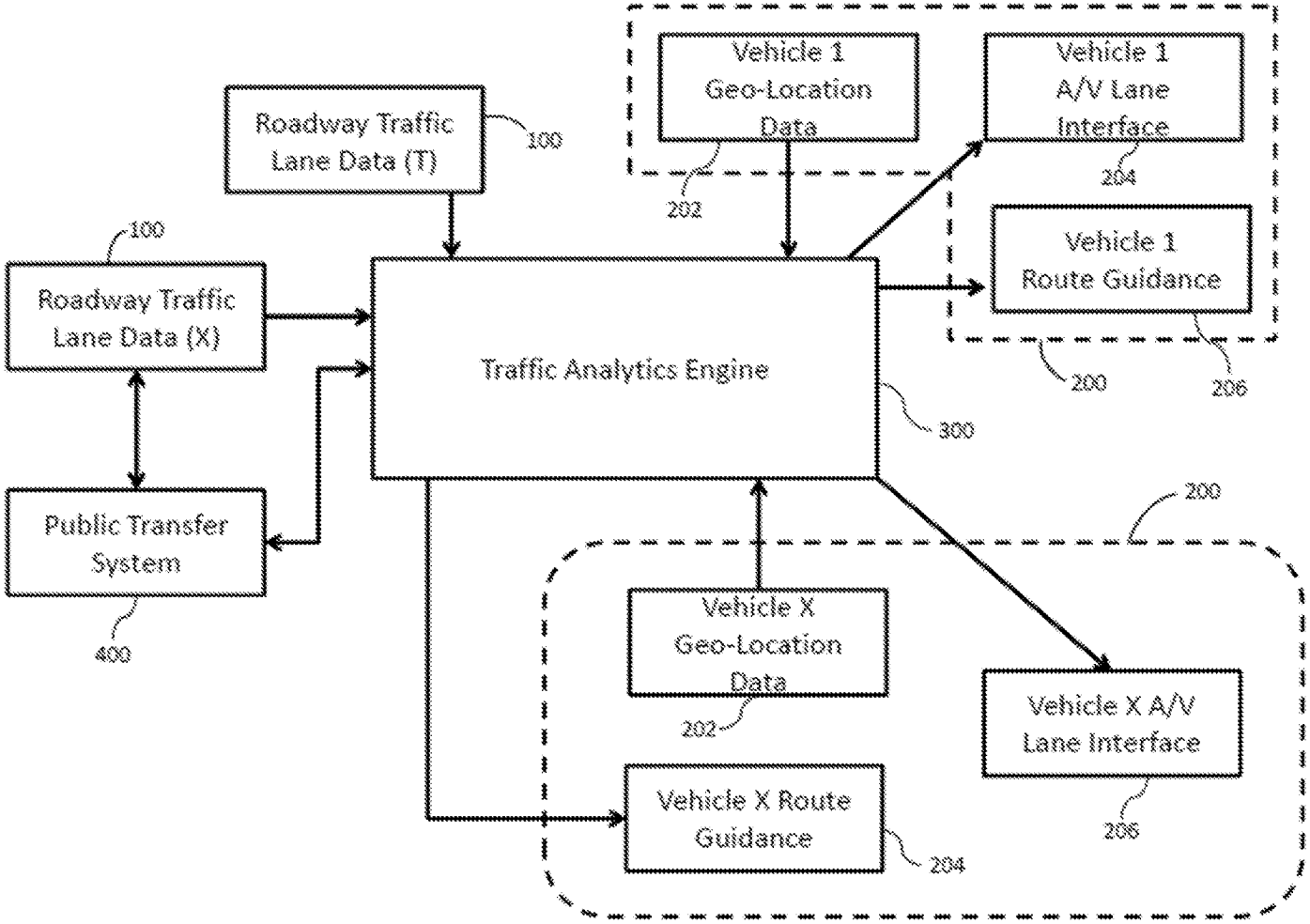
FIG. 1 is a high level schematic diagram of a traffic management and route guidance system.
Figure 2:
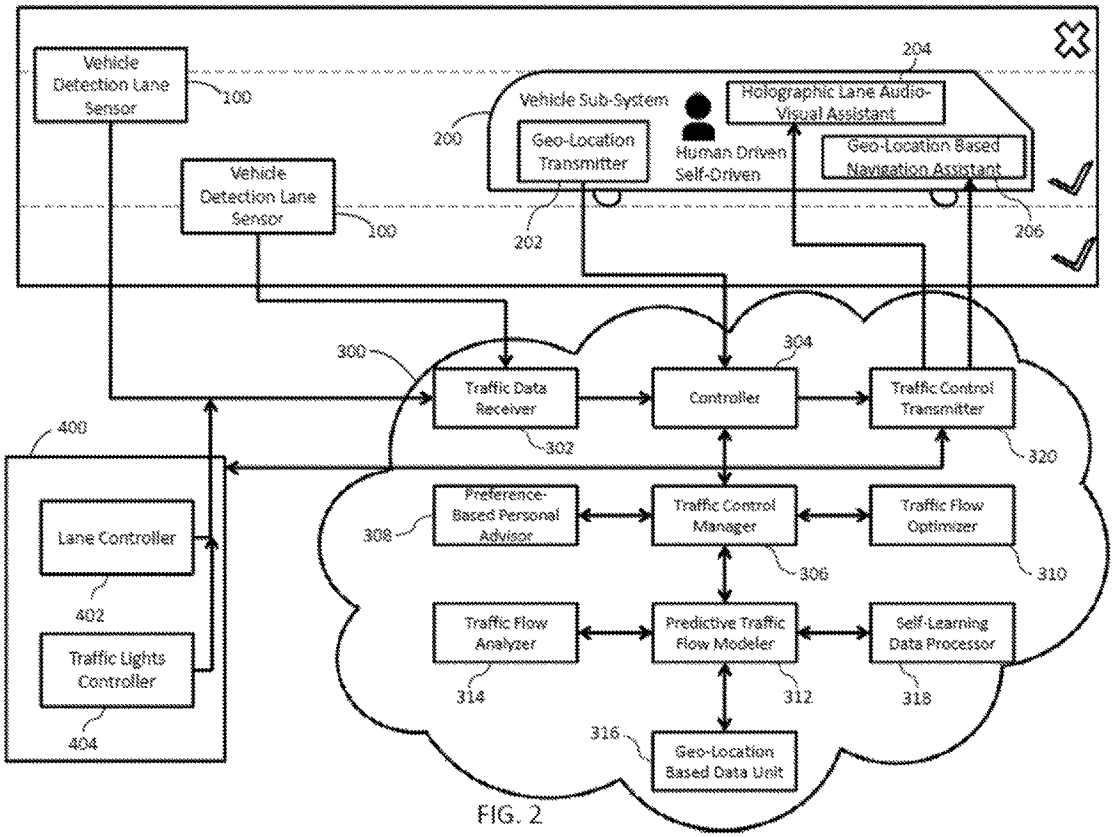
FIG. 2 is a mid-level schematic diagram of a traffic management and route guidance system.

Referring to the Figures, the present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Referring again to the drawings, wherein like reference numerals refer to like parts throughout, there is seen in FIG. 1 a system, designated generally by reference numeral 10, for predictive traffic management using virtual lanes. In an embodiment, system 10 dynamically monitors and collects traffic conditions in real time, performs analytics on the collected traffic data, can provide an allocation/reallocation of lanes available for traffic use to optimize traffic flow, and can provide vehicles (human driver or driverless/self-driving) with real time optimal route guidance, including use of alternate routes.

In one embodiment, system 10 comprises a plurality of smart sensors 100, optical in nature for example, mounted on and/or along lanes 12 of a road 14 (or mounted in locations 12 (e.g., smart sensors mounted on poles, signs, or other supports) that permit sensing traffic conditions existing within lanes 12; a vehicle mounted sub-system 200 housed within a vehicle 16; a computing system 300 that is located remote from the smart sensors 100 and vehicle mounted sub-system 200, and a public transfer system 400 that communicates with computing system 300 and smart sensors 100. System 10 permits predictive traffic management using virtual lanes, and provides vehicles 16 (human driven or driverless) with real-time traffic data feedback and route guidance for purposes of making the vehicular trip most efficiently pursued in terms of minimizing traffic disruption as well as controlling traffic through efficient use of lane allocations and traffic light management via electroic interfacing with public transfer system 400.

Smart sensors 100 are provided on or along roadways 14 lanes 12 to sense passing vehicle traffic on the roadway. Sensors 100 may take the form of optical sensors as one example type, and include a power source 102, computing processor and clock 104 for processing the sensed conditions and creating digital data representative of the sensed conditions, and a transmitter 106 for transmitting the digitized data. More specifically, sensors 100 collect and provide data representative of vehicle traffic in physical driving lanes 12 on roadway 14. Thus, in addition to the particular static location of each sensor 100, each sensor 100 provides data that is informative about the vehicular traffic at any point in time in a physical driving lane 12. Computer processor and clock 104 can be programmed, configured and/or structured to cause transmission of the digitized sensed traffic data at any desired periodicity.

In addition to the static sensors 100 that sense the vehicular traffic along a lanes 12/roadway 14, vehicles 16 are equipped with a vehicle sub-system 200 that includes a geolocation transmitting unit 202, a driver interface 204, and a geolocation based navigation assistance 206. The geolocation transmitting unit 202 is programmed, structured and/or configured to transmit the vehicle's precise physical location data at a desired periodicity. As explained further below, the vehicle's physical location data can be combined and compared with the traffic data provided by the sensors 100 and provide real time feedback to the vehicle about optimum route guidance and lane section via computing system 300, driver interface 204, and navigation assistant 206.

The data from the sensors 100 and the geolocation transmitter 202 are transmitted to a remote computing system 300. More specifically, data from sensors 100 is transmitted to a vehicle traffic data receiver 302 which then aggregates the data from all the sensors 100 (e.g., combines each sensor's physical location with the vehicular traffic data sent from each sensor 100) and then electronically transmits the traffic data to a controller 304 where the data is organized by sensor The data from the vehicle geolocation based transmitter 202 is transmitted directly to controller 304.

Controller 304 receives the aggregated data from traffic data receiver 302 and the vehicle geolocation data from transmitter 202. It then takes that data and sends it to a traffic control manager 306 which bi-directionally exchanges data with a preference based advisor 308, a traffic flow optimizer 310 and a predictive traffic flow modeler 312. Preference based personal advisor 308 comprises data stored in non-transitory memory that is representative of, for example, and among other things, route preferences associated with vehicle 16, weather conditions, accident reports, reports of hazards, other driver input through social media or other communication means that can be monitored, etc. The preferential route data is based upon data collected over for the actual routes followed by a particular vehicle 14 and any customized preferences (e.g., highways, non-toll roads, local routes, etc.) that have been manually input.

Traffic flow optimizer 310 comprises a processing unit that processes the data representative of actual traffic conditions (based on the sensor 100 transmitted data), the geolocation based data provided by geolocation transmitter 202, and data provided by predictive traffic flow modeler 312. Predictive traffic flow modeler 312 comprises an analytics interference engine that bi-directionally communicates with a traffic density analyzer 314, a geolocation based data unit 316, and a self-learning data processor 318 before returning data to traffic control manager 306. Traffic density analyzer 314 comprises a computer processor that processes traffic data first collected by sensors 100 for generating data representative of traffic density on a given roadway 14 and lane 12 at a given instant in time so such data can then be used in further processing by the predictive traffic flow modeler 312 for purposes of predicting traffic patterns on the given roadways 14 and lanes 12 at future times that are useful for purposes of optimizing the present route guidance provided to vehicle 16 (e.g., if the data from traffic density analyzer 314 processed by predictive traffic flow modeler 312 shows heavy traffic will exist on a roadway 14 that would be used by vehicle 16 based on its preferred route at a time when the traffic is heavy, computer system 300 can then redirect vehicle 16 along an alternate route to bypass the heavy traffic conditions that are likely going to exist when vehicle 16 would have reached a given point along its route).

Self-learning data processor 318 continuously receives the predictive traffic flow modeler data showing traffic density conditions at various points in time on specific roadways 14/lanes 12 and shares this data with predictive traffic flow modeler 312 so that it will possess both the traffic density data from density analyzer 314 and the historic traffic data from the self-learning processor 318 and data representative of its inferences of traffic patterns, and can then generate a model that predicts traffic flow using both actual traffic data and an inference engine. In addition, geolocation based data unit 316 provides data that correlates the traffic density data with particular physical locations wherein the data can include, among other things, weather conditions, traffic conditions, accident reports, hazard reports, other driver input into social media or other monitored communication means, etc.

The predictive traffic flow modeler 312 then sends the predictive traffic data to traffic control manager 306 which then combines the predictive traffic data with the preference based data provided from preference based personal advisor 308 and optimum traffic flow data provided from traffic flow optimizer 310 and generates route guidance to controller 304 that is optimized based upon real time traffic data, historic traffic data, and predictive traffic data. Controller 304 will then provide the optimized route guidance and lane selection data to a traffic control transmitter 320. Traffic control transmitter 320 then sends the route guidance and lane selection data to the driver interface 204 and navigation assistant 206. Driver interface 204 provides in one embodiment a holographic display of virtual lanes with the optimized lane being highlighted for the driver of vehicle 16. In addition, it can provide audio cues for the driver to move into a desired lane. Further, navigation assistant 206 can display and provide the optimal navigation route assistance that has been possibly been modified in real time based on the data fed back from computer system 300.

Public transfer system 400 comprises a lane controller 402 (e.g., an automatically controlled gate) and traffic lights controller 404. The traffic data from sensors 100 is transmitted to public transfer system 400 so that it contains the real time traffic data for each lane 12. In addition, public transfer system exchanges data (transmits to and receives from) computer system 300 so that it also has stored therein the predictive traffic modeling provided by computer system 300. Based on the real time traffic lane data and the predictive traffic flow data, public transfer system 400 can send signals from its traffic lane controller to physically alter lane allocations by either closing one lane (e.g., lane marked with an X in FIG. 1) for traffic going in one direction while leaving open the other lanes, and permit traffic to flow in the opposite direction in the one lane in order to accommodate and efficiently impact real time traffic conditions. In addition, the data provided to public transfer system 400 can be provided to traffic light controller 404 for purposes of providing signals to physical traffic lights to change their pre-programmed patterns and permit more optimal patterns to accommodate the real time actual traffic patterns on roadway 12.

Figure 3:
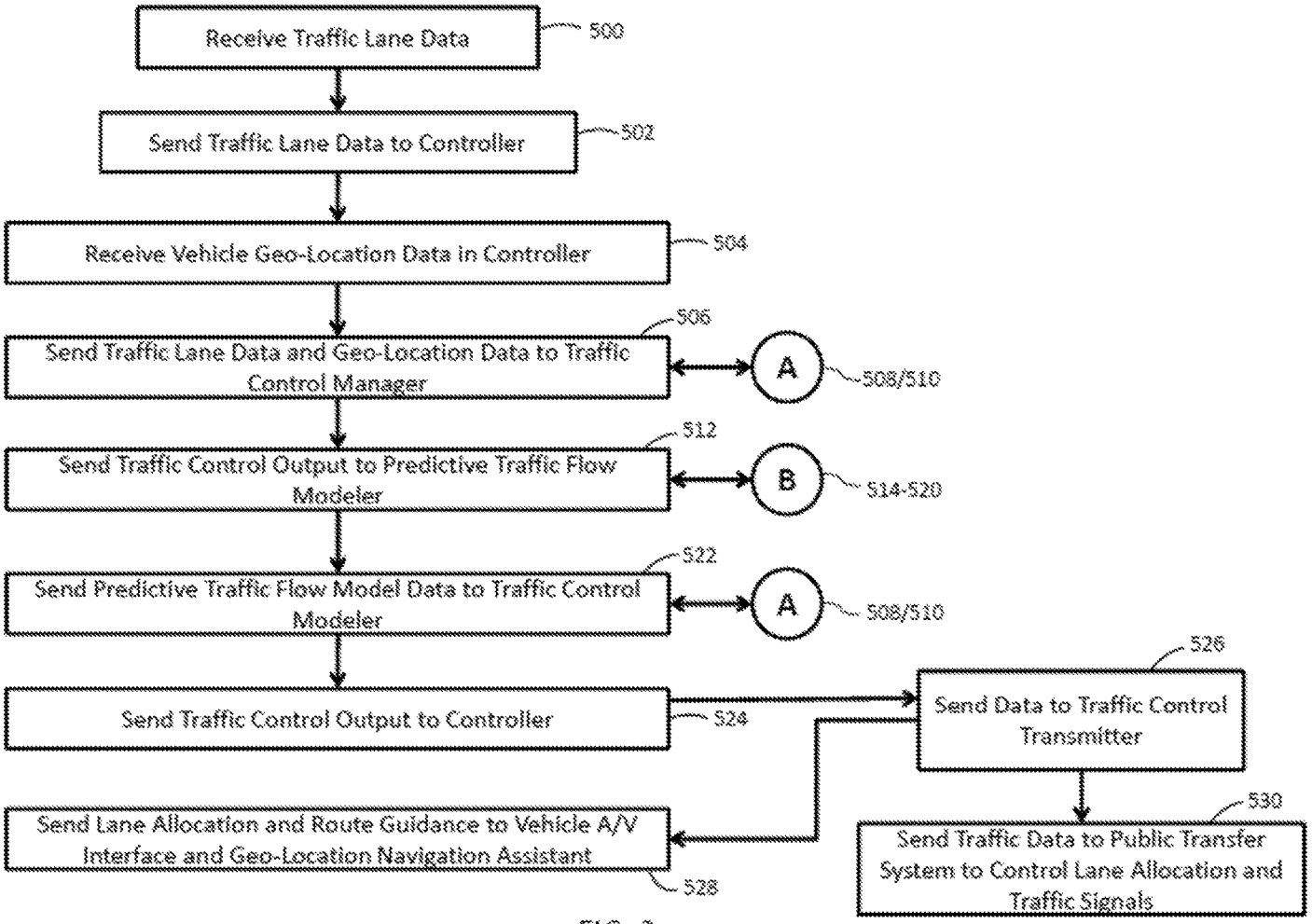
FIG. 3 is a high level flow chart of a traffic management and route guidance process.
Figure 4:
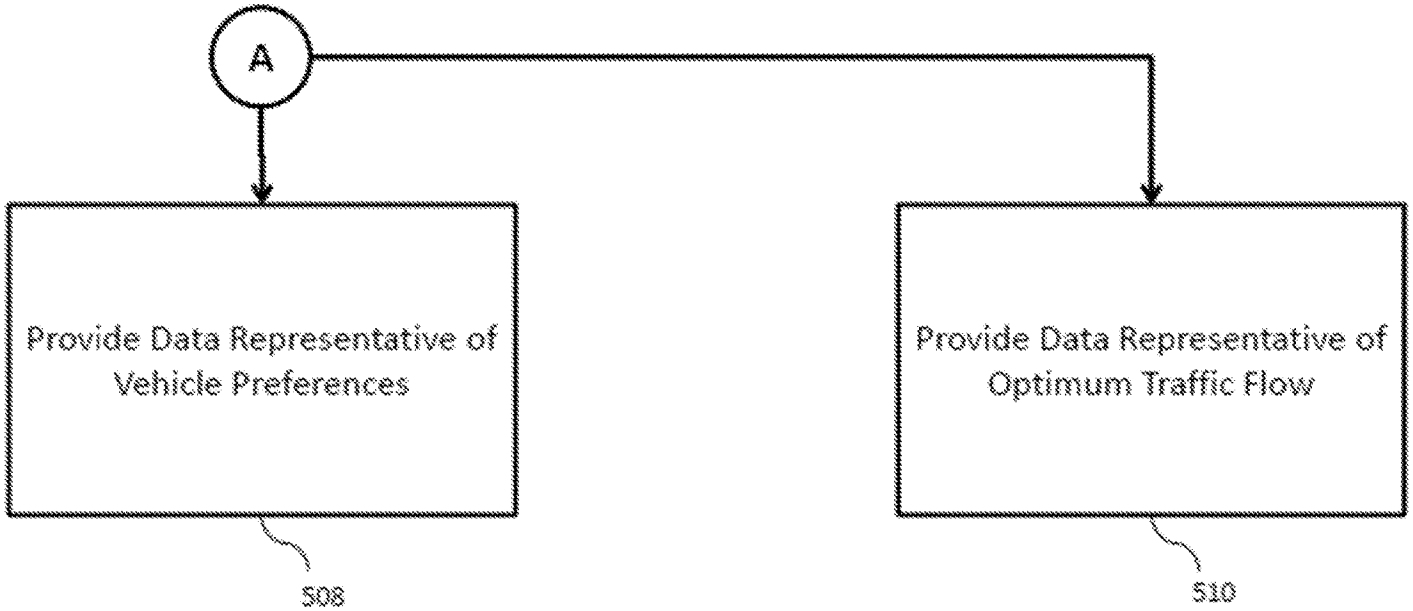
FIG. 4 is a flow chart of a traffic control determination process.
Figure 5:
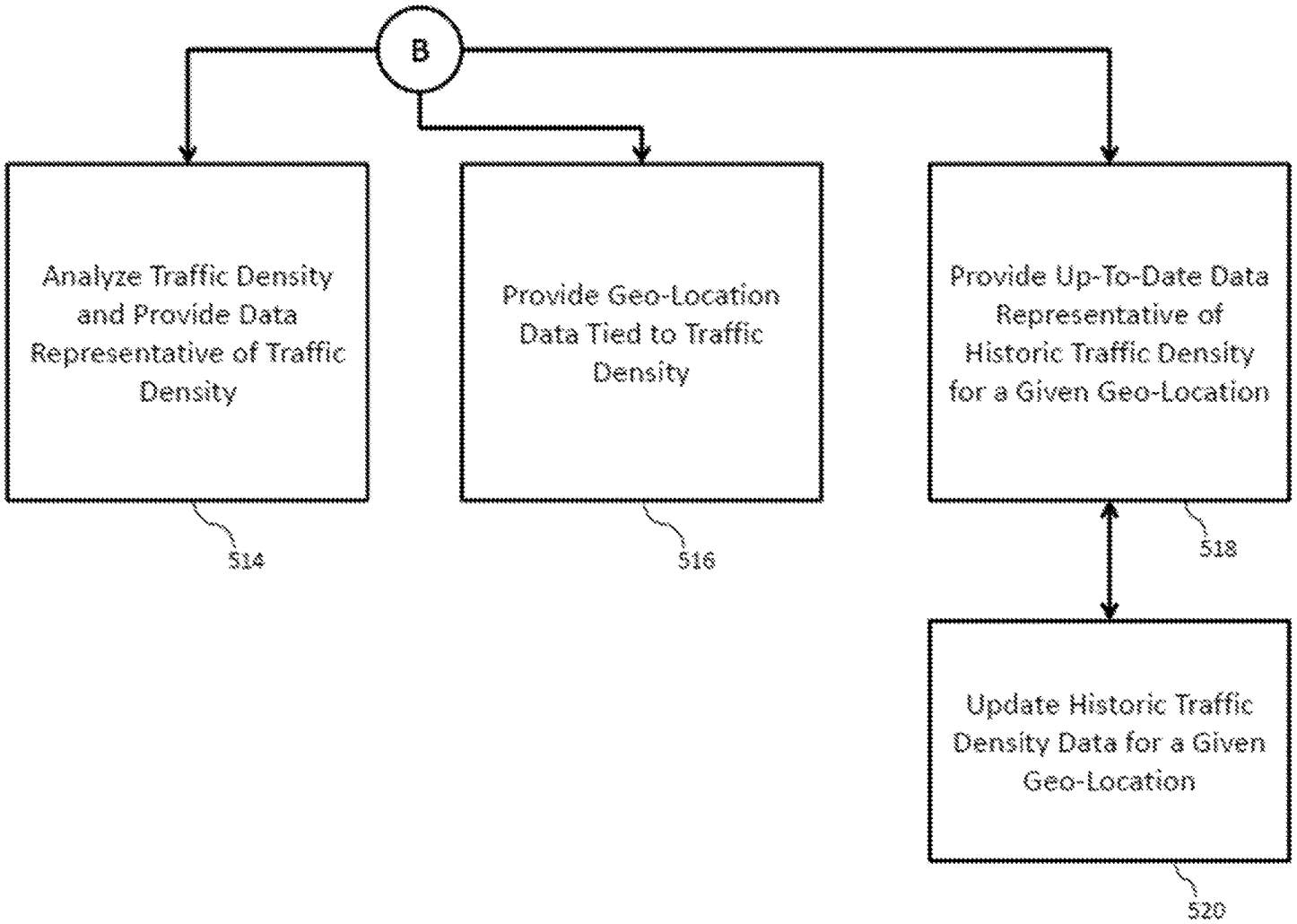
FIG. 5 is a flow chart of a predictive traffic management process.

With reference to FIGS. 3-5, a non-limiting, illustrative embodiment of the process associated with system 10 as described above is provided. As a first step 500, traffic lane data is collected from sensors 100 and then sent to controller 304 via receiver 302 in step 502. Simultaneously or at designated times vehicle geo-location data sent from geo-location transmitter 202 is received in controller 304 in step 504. The traffic lane data and geo-location data is then sent to traffic control manager 306 in step 506. Concurrently and iteratively in an on-going process, the traffic control manager 306 transmits and receives this data with the preference based personal advisor 308 and traffic flow optimizer 310 in steps 508 and 510. The data ouput from traffic control manager 306 is then sent to the predictive traffic flow modeler 312 in step 512. From the flow modeler 312, data is provided to traffic flow analyzer 314 in step 514, to geo-location based data unit 316 in step 516, and to self-learning data processor 318 in step 518 which then updates historic traffic density for a given geo-location in step 520. This data is then returned from traffic flow modeler 312 to traffic control manager 306 in step 522 where it is once again sent to preference based personal advisor 308 in step 508 and to traffic flow optimizer 310 in step 510. The processed and analyzed data output is then sent from traffic control manager 306 to controller 304 in step 524 and then passed on to traffic control trasnmetter 320 in step 526. Traffic control transmitter 320 then transmits the lane allocation and route guidance data via any conventional and well understood communication protocol to the geo-location based navigation assistant 206 and the holographic lane audio-visual assistant 204 (or any other type of visual and/or audio driver aid) in step 528. Simultaneously, traffic control transmitter 320 will also send the data to public transfer system 400 for purposes of controlling traffic lights and lane allocations in step 530.

What is claimed is:

1. A system for providing predictive traffic management and lane allocation based on a vehicle's current position, comprising:

a) a plurality of sensors adapted for positioning along a roadway, detecting the movement of vehicles operatively passing said sensor and generating vehicle movement data, and transmitting said vehicle movement data;

b) a public transfer system;

c) a vehicle sub-system, comprising:

i) a first geo-location based transmitter adapted for attachment to the vehicle and generating and transmitting vehicle position; and ii) a navigation assistant;

iii) one or more customized route or routing preferences; and d) a computing system located remote from said plurality of sensors, said public transfer system, and said vehicle sub-system, and is configured to exchange data with said public transfer system, comprising:

i) a digital receiver configured to receive said vehicle movement data transmitted from said plurality of sensors, and further configured to aggregate the vehicle movement data from the plurality of sensors into aggregate vehicle movement data;

ii) a digital controller adapted to receive: (i) said aggregate vehicle movement data from said digital receiver; and (ii) said vehicle position data from said first geo-location based transmitter; and (iii) processed traffic data comprising route guidance from a traffic control management module;

iii) a traffic control management module configured to process traffic data and transmit said processed traffic data to said digital controller as route guidance for one or more vehicles;

iv) a predictive traffic flow modeler comprising an inference engine configured to generate predictive traffic data model which predicts one or more traffic patterns on the roadway using at least historic traffic data, information from a traffic density analyzer comprising traffic density conditions at a plurality of time points for the roadway, information from a geo-location based data unit comprising vehicle geo-location data, and information from a self-learning data processor, wherein the predictive traffic flow modeler is configured to send said predictive traffic data model to said traffic control management module;

v) a traffic flow optimizer configured to optimize said processed traffic data utilizing at least said aggregate vehicle movement data and said predictive traffic data model to generate optimized traffic flow data comprising one or more optimized routes, wherein the traffic flow optimizer is configured to send said optimized traffic flow data to said traffic control management module;

vi) a preference-based personal advisor configured to receive personal advisor data comprising: (i) the one or more predetermined customized route or routing preferences; (ii) one or more weather conditions along at least a portion of the roadway; and (iii) one or more roadway reports received from one or more drivers or vehicles, and further configured to send said personal advisor data to said traffic control management module; and vii) a digital transmitter configured to receive optimized route guidance data from said digital controller and transmit said data to said navigation assistant;

wherein the traffic control management module is adapted to generate optimized route guidance data based at least in part on said predictive traffic data model, said optimized traffic flow data, and said personal advisor data.

2. The system according to claim 1, wherein said public transfer system comprises a lane controller and a traffic light controller.

3. A method for providing predictive traffic management and lane allocation based on a vehicle's current position, comprising the steps of:

a) receiving in a computing system data representative of sensed vehicular traffic from traffic lanes on a roadway, wherein the data comprises vehicle positions transmitted by a plurality of geo-location based transmitters each attached to a vehicle;

b) aggregating said sensed vehicular traffic data in a computer controller;

c) receiving in said computing system geolocation data for a vehicle;

d) providing said computing system with data representative of preferred traffic guidance for said vehicle, said preferred traffic guidance comprising (i) one or more predetermined customized route or routing preferences for said vehicle; (ii) one or more weather conditions along at least a portion of the roadway; and (iii) one or more roadway reports received from one or more drivers or vehicles;

e) generating, by a predictive traffic flow modeler of said computing system and comprising an inference engine, modeled data representative of predictive traffic flow for said traffic lanes, wherein the predictive traffic flow modeler is configured to generate said modeled data using at least historic traffic data, information from a traffic density analyzer comprising traffic density conditions at a plurality of time points for the roadway, information from a geo-location based data unit comprising vehicle geo-location data, and information from a self-learning data processor;

f) generating, by a traffic flow optimizer of said computing system using said vehicle data representative of route guidance instructions based upon said predictive traffic flow data, said vehicular traffic data, and said preferred traffic guidance data, optimized vehicle route guidance instructions;

g) transmitting, from said computing system to said vehicle, said optimized route guidance instructions; and h) transmitting from said computing system to a public transfer system data to control traffic lights and lane allocations.

4. The method according to claim 3, further comprising generating a visual image in said vehicle of a virtual driving lane representative of said route guidance instructions.

5. The method according to claim 3, further comprising generating navigation assistance in said vehicle representative of said route guidance instructions.

6. A computer program product providing predictive traffic management and lane allocation based on a vehicle's current position, the computer program product comprising a computer readable storage medium having program instructions embodied therewith, wherein the computer readable storage medium is not a transitory signal per se, the program instructions are readable by a computer to cause the computer to perform a method comprising:

a) receiving in a computing system data representative of sensed vehicular traffic from traffic lanes on a roadway, wherein the data comprises vehicle positions transmitted by a plurality of geo-location based transmitters each attached to a vehicle;

b) aggregating said sensed vehicular traffic data in a computer controller;

c) receiving in said computing system geolocation data for a vehicle;

d) providing said computing system with data representative of preferred traffic guidance for said vehicle, said preferred traffic guidance comprising (i) one or more predetermined customized route or routing preferences for said vehicle; (ii) one or more weather conditions along at least a portion of the roadway; and (iii) one or more roadway reports received from one or more drivers or vehicles;

e) generating, by a predictive traffic flow modeler of said computing system and comprising an inference engine, modeled data representative of predictive traffic flow for said traffic lanes, wherein the predictive traffic flow modeler is configured to generate said modeled data using at least historic traffic data, information from a traffic density analyzer comprising traffic density conditions at a plurality of time points for the roadway, information from a geo-location based data unit comprising vehicle geo-location data, and information from a self-learning data processor;

f) generating, by a traffic flow optimizer of said computing system using said vehicle data representative of route guidance instructions based upon said predictive traffic flow data, said vehicular traffic data, and said preferred traffic guidance data, optimized vehicle route guidance instructions;

g) transmitting, from said computing system to said vehicle, said optimized route guidance instructions; and h) transmitting from said computing system to a public transfer system data to control traffic lights and lane allocations.

7. The computer program product according to claim 6, wherein the program instructions readable by a computer to cause the computer to perform a method further comprise generating a visual image in said vehicle of a virtual driving lane representative of said route guidance instructions.

8. The method according to claim 6, wherein the program instructions readable by a computer to cause the computer to perform a method further comprise generating navigation assistance in said vehicle representative of said route guidance instructions.

* * * * *